US012611002B1

(12) United States Patent
Dale et al.

(10) Patent No.: US 12,611,002 B1
(45) Date of Patent: Apr. 28, 2026

(54) VENTED FOOTWEAR

(71) Applicant: Wolverine Outdoors, Inc., Rockford, MI (US)

(72) Inventors: Dewayne Dale, Howard City, MI (US); Eric P. Fracassi, Grandville, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 0 days.

(21) Appl. No.: 19/083,944

(22) Filed: Mar. 19, 2025

(51) Int. Cl.
*A43B 7/06* (2006.01)

(52) U.S. Cl.
CPC ..... *A43B 7/06* (2013.01)

(58) Field of Classification Search
CPC ..... A43B 7/06; A43B 7/085; A43B 5/1666; A43B 5/1675; A43C 11/002; A43C 11/004
USPC ..... 36/3 R
See application file for complete search history.

(56) References Cited

U.S. PATENT DOCUMENTS

| | | | | |
|---|---|---|---|---|
| 3,807,062 | A | 4/1974 | Spier | |
| 4,562,652 | A | 1/1986 | Hensler | |
| 6,401,364 | B1 * | 6/2002 | Burt | A43B 1/00 36/3 R |
| D460,605 | S | 7/2002 | Whittington | |
| D513,554 | S | 1/2006 | Matis et al. | |
| D867,728 | S | 11/2019 | Whittington | |
| D959,815 | S | 8/2022 | Cristobal | |
| 11,464,291 | B2 | 10/2022 | Fuerst | |
| 11,998,084 | B2 | 6/2024 | Fuerst | |
| 2003/0192204 | A1 | 10/2003 | Miller et al. | |
| 2006/0162190 | A1 | 7/2006 | Nishiwaki et al. | |
| 2010/0269369 | A1 * | 10/2010 | Nishiwaki | A43B 23/047 36/28 |
| 2011/0035963 | A1 * | 2/2011 | Baker | A43B 13/40 36/114 |
| 2012/0167418 | A1 * | 7/2012 | Frappier | A43B 23/26 36/115 |
| 2014/0352179 | A1 * | 12/2014 | Bell | D04B 21/207 66/170 |
| 2019/0104803 | A1 * | 4/2019 | Jeong | A43B 7/08 |
| 2022/0400815 | A1 * | 12/2022 | Beers | A43B 23/028 |
| 2024/0148111 | A1 | 5/2024 | Fuerst | |

* cited by examiner

*Primary Examiner* — Timothy K Trieu
(74) *Attorney, Agent, or Firm* — Warner Norcross + Judd LLP

(57) ABSTRACT

A footwear construction including an upper defining an aperture rearward of a toe box in or near an instep and a vent panel defining holes secured to the upper over the aperture to provide venting to a user's foot in the upper. An outsole can be joined with the upper. The holes can be slots extending across a longitudinal axis of the footwear, separated from one another by respective transverse beams that can be parallel to the slots. A mesh panel can be disposed adjacent an interior of the vent panel, and airflow can pass through the holes and mesh providing venting. The vent panel can include a boundary step, and the aperture can define a boundary edge that can be stitched to and interfit to one another so that an exterior of the upper is flush with and/or smoothly transitions to an exterior of the vent panel.

20 Claims, 6 Drawing Sheets

VENTED FOOTWEAR

BACKGROUND OF THE INVENTION

The present invention relates to footwear, and more particularly to venting for work boots and other rugged footwear.

Work boots are an essential part of protective gear for individuals engaged in physically demanding occupations, such as construction, manufacturing, and outdoor labor. These boots are designed to provide durability, support, and protection against environmental hazards, including falling heavy objects, rough terrain and extreme weather conditions. While work boots effectively shield the wearer's feet from external dangers, they often create a secondary issue: excessive perspiration and discomfort due to inadequate ventilation.

Perspiration buildup in work boots can lead to several problems, including odor, bacterial and fungal growth, and overall discomfort. Prolonged exposure to excessive moisture may result in skin irritation, blisters, and more severe conditions such as athlete's foot. These issues not only compromise the health and well-being of the wearer but also reduce productivity by necessitating breaks or sock or footwear changes. Additionally, moisture accumulation can deteriorate the internal materials of the boot, shortening its lifespan and increasing the need for replacement footwear.

To address this problem, various ventilation solutions have been incorporated into work boots. Conventional approaches include perforated uppers, breathable linings, and moisture-wicking insoles. Some designs integrate flat mesh fabric panels to promote airflow. However, these solutions often come with trade-offs. Perforations and fabric mesh panels may weaken the structural integrity of the boot, making it less resistant to punctures, water ingress, and other external hazards. Depending on the placement of the perforations and fabric mesh panels, these components can offer less protection, particularly when heavy objects are dropped on the boot or the boot undergoes excessive abrasion in a work environment. Moisture-wicking linings can help absorb sweat but do not necessarily facilitate adequate air circulation to expel moisture effectively. Furthermore, many of these existing ventilation methods fail to provide continuous airflow while maintaining the necessary durability and protection required for hazardous work environments.

Thus, there remains a need for an improved ventilation system in work boots that effectively reduces moisture buildup, enhances comfort, and extends the longevity of the footwear without compromising safety and durability. The present invention seeks to overcome these limitations by providing an innovative solution to enhance airflow within the boot while preserving its protective capabilities.

SUMMARY OF THE INVENTION

A footwear construction is provided including an upper defining an aperture rearward of a toe box in or near an instep, and a vent panel defining holes secured to the upper over the aperture to provide venting to a user's foot in the upper.

In one embodiment, the holes can be formed as openings or slots extending across a longitudinal axis of the footwear, separated from one another by respective transverse beams that can be aligned with the openings or slots. The slots can extend completely through a thickness of the vent panel so that airflow can pass through the slots to an interior void within the upper.

In another embodiment, the vent panel can be of a hyperbolic paraboloid shape and disposed rearward of the toe box. The shape can meld over an instep of the upper, in the location of the aperture. The vent panel can extend upward adjacent and/or above the ankle of the upper.

In still another embodiment, the slots or opening can be parallel to one another and perpendicular to the longitudinal axis. The vent panel can include a boundary step. A boundary edge of the upper can be nested in the boundary step. A stitch extends through the boundary step, the boundary edge, and a mesh edge of the mesh panel around the aperture, thereby securing the vent panel to the upper.

In yet another embodiment, the boundary edge can extend around the aperture along a medial side and a lateral side thereof. The boundary edge can have a first thickness. The vent panel can be disposed over the aperture and joined with the boundary edge. The vent panel can include a central portion aligned with a longitudinal axis of the upper and the footwear. The vent panel boundary step can include a stitching flange and a wall extending away from the stitching flange. The stitching flange can include a second thickness. The boundary step can be stitched to the boundary edge around the aperture with a stitch extending through the first thickness and the second thickness with the boundary edge being disposed adjacent the wall.

In even another embodiment, the boundary step can include an outer step surface. The outer step surface can transition to the wall, which can transition to the stitching flange. The stitching flange and outer step surface can be offset vertically from one another, forming a step at the wall. The boundary edge can include an outer edge surface. The outer step surface and outer edge surface can be flush with one another. The boundary edge can include an outer surface that is abutted against the wall.

In a further embodiment, the vent panel can be constructed from a polymer material and the upper can be constructed from a leather, textile or other natural or synthetic material. The vent panel can be joined with the boundary edge around the aperture with a stitching thread extending through the vent panel and the upper. Where the vent panel outer surface and the upper outer surface are joined at a boundary step and flush, the transition between the materials is smooth and aesthetically pleasing.

In still a further embodiment, the beams can include a medial end and a lateral end. The medial end can be joined with a medial support extending on the medial side. The lateral end can be joined with a lateral support extending on the lateral side. The boundary step can extend along the medial support and along the lateral support.

In yet a further embodiment, the beams can taper in cross section from an interior surface of each beam to an exterior surface of each beam, such that each beam is wider near the void or interior of the upper in which a user's foot can be disposed.

In even a further embodiment, each of the beams can include a trapezoidal cross section. Each of the beams can include an exterior face and an interior face. The interior face can include a first width and the exterior face can include a second width. The first width can be greater than the second width.

In another embodiment, a mesh panel can be joined with the vent panel. The mesh panel can cover at least the plurality of slots or openings on an interior of the vent panel or adjacent the void in the upper. The mesh panel can be a fabric, textile, woven, nonwoven, knit or other material, or even a waterproof breathable membrane or material. The mesh panel can also allow airflow therethrough to provide venting to the interior of the footwear and a user's foot therein.

In still another embodiment, the mesh panel can be joined with the boundary stop or a perimeter of the vent panel. The mesh panel can be joined around the aperture with a stitching thread extending through the vent panel and the upper. The stitching thread can extend through the mesh to join the mesh with the vent panel around the aperture.

In yet another embodiment, the mesh can be conformed to the hyperbolic paraboloid shape of the vent panel. The mesh panel can be joined to the vent panel along a lateral support and along the medial support. The mesh panel can be joined along an upper support and a lower support as well.

In even another embodiment, the footwear can be a ranch or work boot including a tongueless, lace-less upper, having a shaft extending upward from the instep. The vent panel can extend over the instep and adjacent or past an ankle region of the upper. The vent panel can thus provide venting to an otherwise relatively closed boot upper, which can be made of durable leather, canvas or other materials not always prone to breathability.

In a further embodiment, the upper instep can transition to a shaft void of a tongue and a lace. The shaft can extend above the ankle region. The shaft can include a plurality of stitching elements. The shaft can include a first finger strap on the lateral side and a second finger strap on the medial side along an upper portion of the shaft. The finger straps can provide a user with holding points when donning the footwear on the user's foot.

In still a further embodiment, the vent panel can be disposed over the instep in a region that is compressed during a natural gait to expel the air from the upper during toe roll. The configuration of the vent can draw in airflow upon toe off and stride as the upper expands to its former shape. This action can enhance airflow into and out of the upper void and footwear in general.

The current embodiments provide a footwear construction with exceptional venting to cool and ventilate a wearer's foot inside the footwear. Airflow can pass through the openings or slots in the vent panel, and the mesh panel wherein included, and into the void and vice versa to provide venting to a user's foot disposed in the footwear. The vent panel can be placed above the toe box, in the instep and adjacent or above the ankle region to allow heat within the void of the upper to exit.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
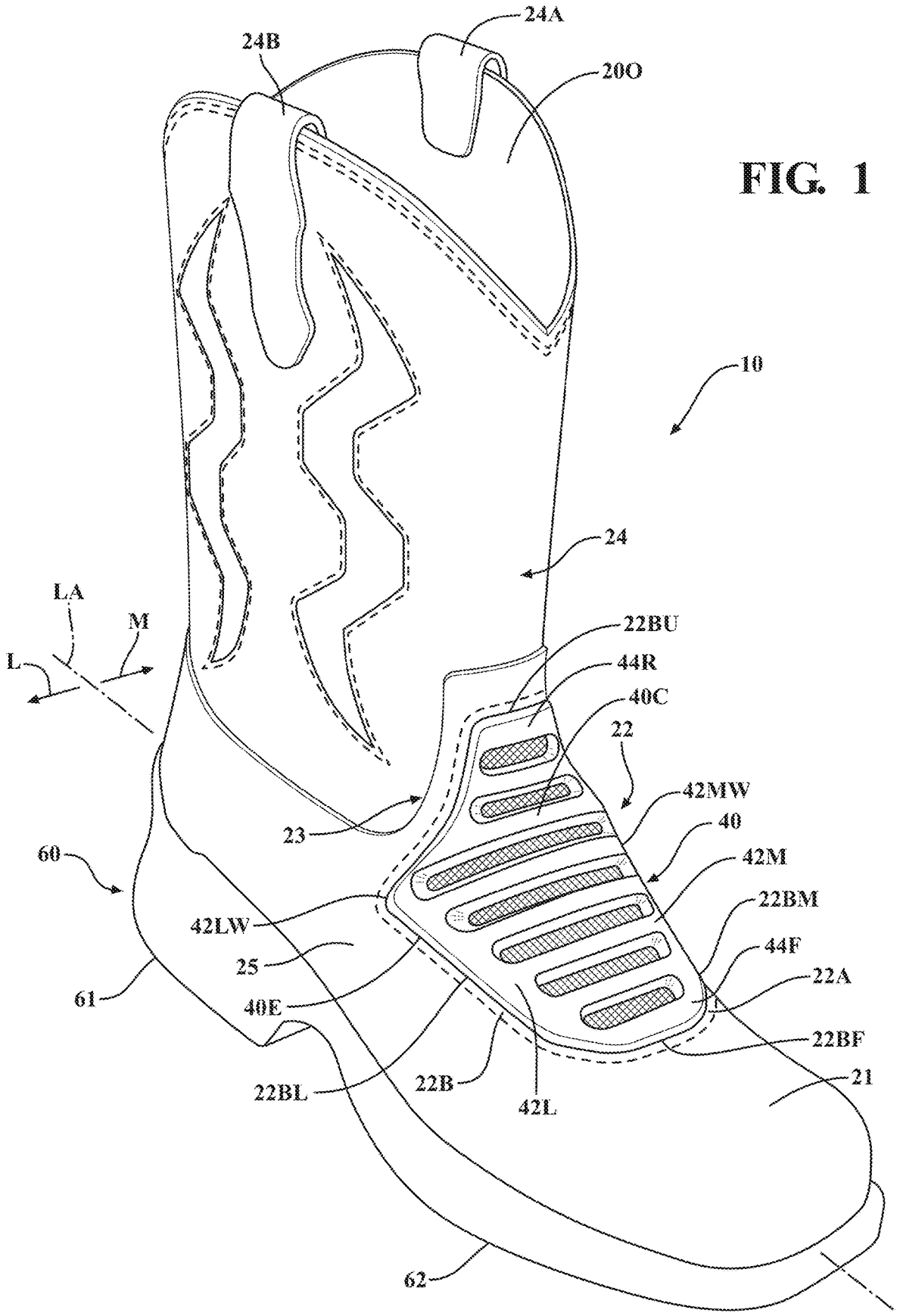
FIG. 1 is a perspective view of the footwear construction of a current embodiment including a vent panel in an instep region.

A current embodiment of the footwear construction is shown in FIGS. 1-6 and generally designated 10. In this embodiment, the footwear 10 includes an upper 20, a vent panel 40, and a sole assembly 60 including an outsole. Although the current embodiment is illustrated in the context of a lace-less, tongue-less Wellington style work boot, the components, features and aspects thereof can be incorporated into any type or style of footwear, including performance shoes, trail shoes and boots, work boots, rancher boots, cowboy boots, all-terrain shoes, hiking shoes, athletic shoes, running shoes, sneakers, conventional tennis shoes, walking shoes, multisport footwear, casual shoes, dress shoes or any other type of footwear or footwear components, whether or not including a tongue, laces or a shaft for receiving a wearer's foot, ankle and/or calf. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe.

The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 12, arch region or mid-foot region 14, and heel region 16 generally are identified in FIG. 1; however, delineation of these regions may vary depending upon the configuration of the sole assembly and/or footwear.

Figure 2:
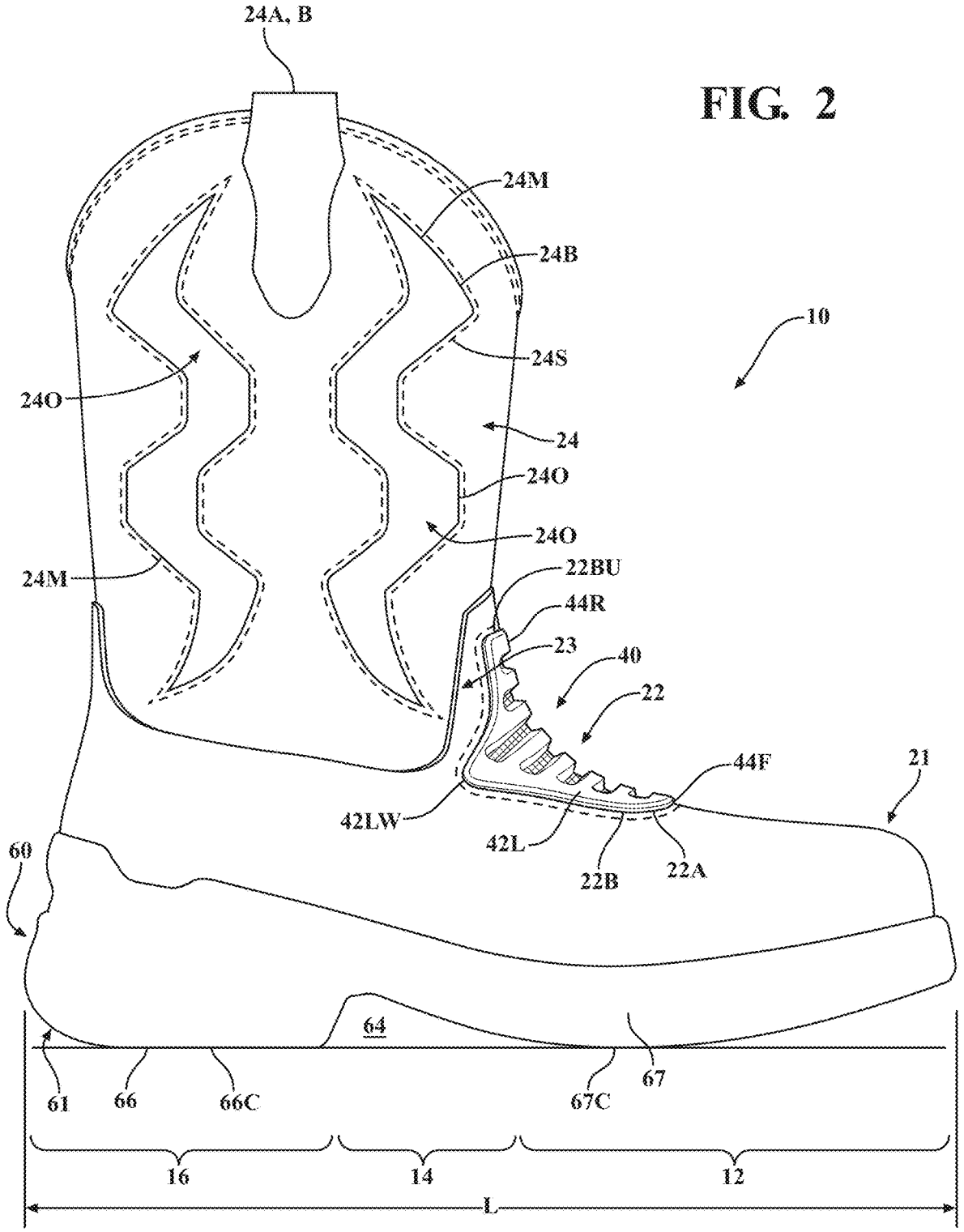
FIG. 2 is a side view of the footwear construction and the vent panel in the instep region.
Figure 6:
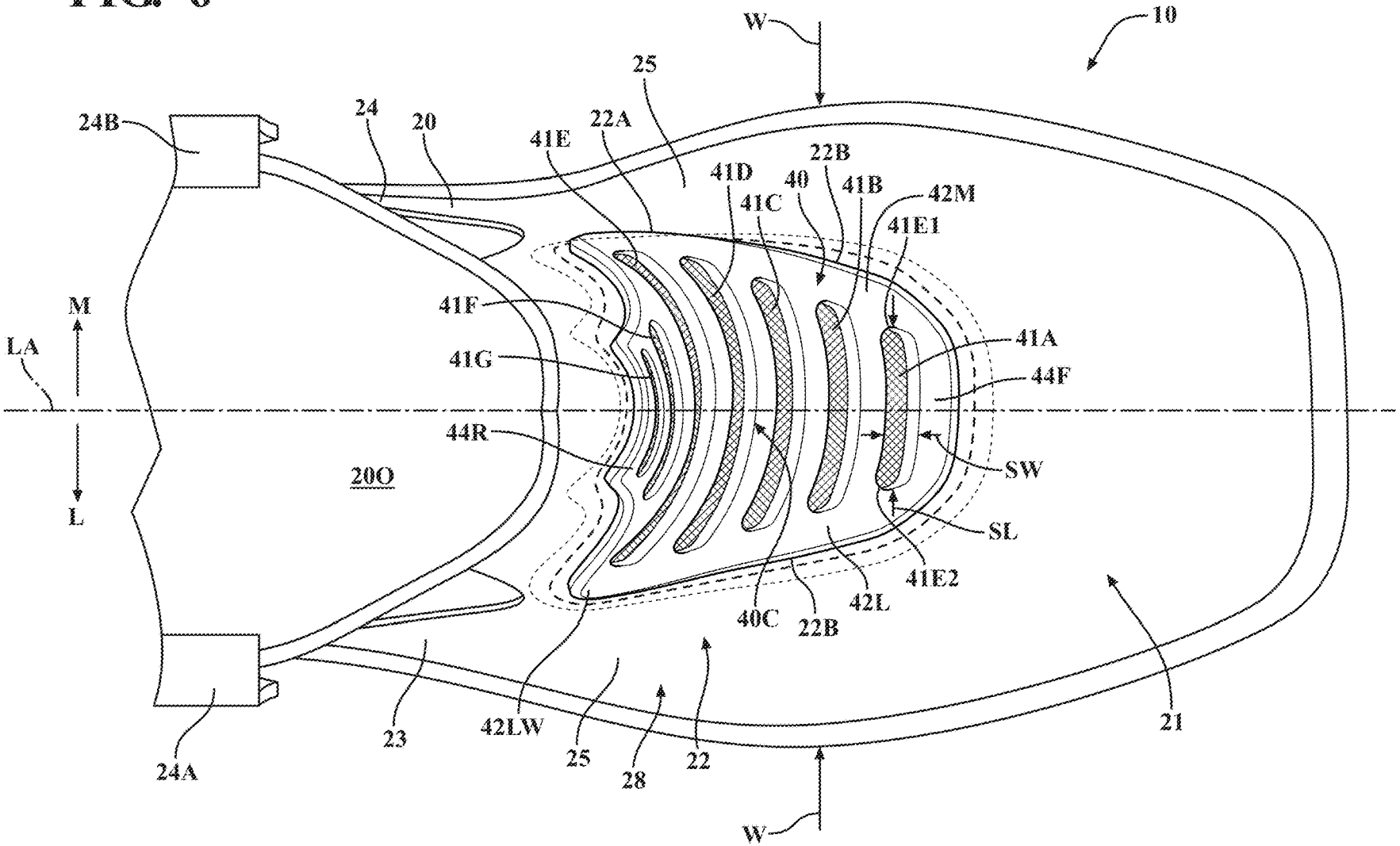
FIG. 6 is an upper view of the footwear construction and the vent panel.

As shown in FIGS. 1, 2 and 6, the upper, sole assembly and footwear in general, can include a side-to-side width W, a heel-to-toe longitudinal length L and a longitudinal axis LA, which can be shared with all components of the footwear. The footwear and its components can include a lateral side L and a medial side M on opposite sides of the longitudinal axis LA.

With reference to FIGS. 1-6, the footwear 10 can include a sole assembly 60. The sole assembly 60 can include a midsole having optional cushioning material, and an outsole 64. More or fewer elements of the sole assembly 20 can be included in some embodiments. The components of the sole assembly can individually and/or collectively provide the article of footwear 10 with a number of attributes and functionality, such as providing cushioning, energy absorption during a normal gait cycle, providing underfoot protection, slip resistance, providing side to side support, rigidity and stability while establishing comfort, reduced weight, and/or other attributes. Generally, regardless of which components are present, the sole assembly 60 can form the bottommost portion of the footwear 10.

As illustrated in FIG. 2, the sole assembly 60 and outsole 65 can include an elevated heel 66 in a heel region 16 of the footwear, common to the type of boot shown there. The elevated heel 66 can include a first part of the plurality of ground contacting treads 66C. The sole assembly and outsole can include a forward portion 62 in a forefoot region 12 of the footwear construction 10. The forward portion 62 can include a second part of the plurality of ground contacting treads 62C. The elevated heel 66 and the forward portion 67 can be separated from one another by a gap 64 in the arch region 14 where none of the ground contacting treads are located. Of course, in other footwear constructions, the sole assembly and outsole can be configured differently.

As mentioned above, the footwear 10 can include an upper. The upper 20 as shown in FIGS. 1-6 can generally form a void 20V configured to receive a foot of a user. The upper can include or overlap the above noted forefoot region 12, arch region 14 and heel region 16. The upper can overlap the longitudinal axis LA extending along a length of the upper and separating the upper into the lateral side L and medial side M described above, similar to other components of the footwear 10. The upper 20 can include various components and pieces, overlapping or forming different parts of the upper. The upper 20 shown can be for a Wellington-style boot but can be modified for other types of boots and footwear depending on the application.

As shown, the upper can include a toe box 21, an instep 22, an ankle portion 23, and a shaft 24. Optionally, finger straps 24A, 24B can be incorporated at the top of the shaft on the lateral and medial sides of the footwear, allowing for an improved grip to facilitate entry and removal of the boot. The toe box 21 can be located at the front portion of the boot, in the front part of the forefoot region 12 and can serve as a protective enclosure for the wearer's toes. It can be constructed to provide reinforcement against external forces while maintaining sufficient interior space to accommodate natural toe movement. The toe box as illustrated can be made from leather, and that leather material can be continuous with, or stitched to, other parts of the upper, such as the instep, ankle portion and shaft. Of course, the toe box in other application can be made from a variety of materials, including leather, thermoplastic polyurethane (TPU), or reinforced leather, depending on the intended application, and further optionally can be constructed to include a protective toe made from metal, polymers and/or plastic.

The toe box 21 can transition to the instep 22, which can be positioned rearward of the toe box. The instep 22 can extend over the upper part of the footwear. The instep can form a midfoot portion of the upper. This section can provide structural support while ensuring a comfortable fit over the top of the wearer's foot. The instep can be contoured to improve ergonomics and prevent excessive foot movement within the boot. For example, the instep can be in the form of a hyperbolic paraboloid, optionally curving about two axes. Depending on material selection, the instep may feature a slight flex to accommodate walking motion while maintaining its shape.

Figure 5:
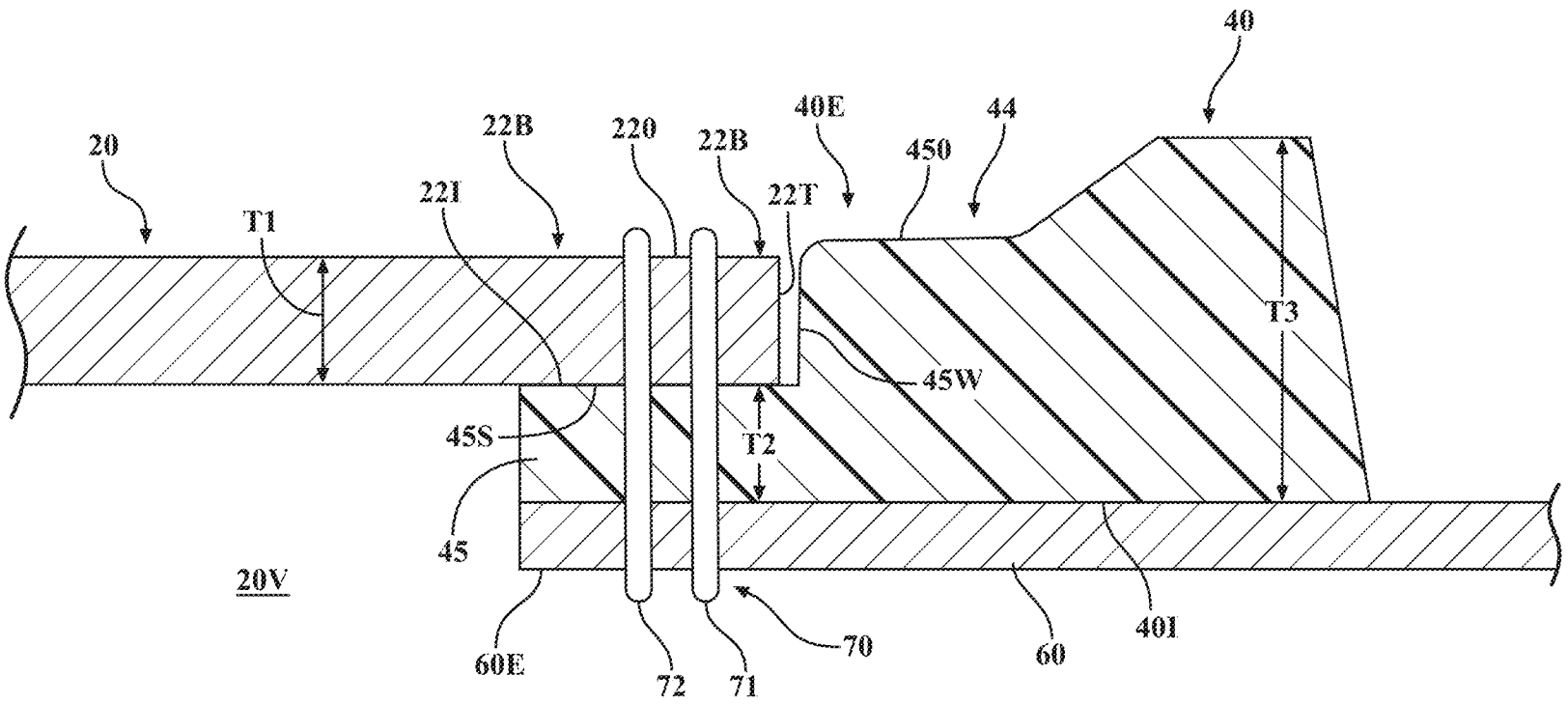
FIG. 5 is a close up view of the vent panel with a boundary step thereof stitched to a boundary edge of the upper.

The instep 22 also can be modified to define an aperture 22A, which aperture can occupy a substantial portion of the instep. The aperture 22A can be bounded by a boundary edge 22B that extends around the aperture along the medial side and the lateral side, as well as near the toe box and the ankle portion 23 as described below. The boundary edge 22 can include a forward boundary edge 22BF that is between the toe box and the vent panel 40 as described below. The forward boundary edge 22BF can transition to a lateral boundary edge 22BL and a medial boundary edge 22BM. These can extend along the edges or outer perimeter of the vent panel 40 to transition to the rearward or uppermost boundary edge 22BU. This boundary edge 22BU of the aperture 22A can be disposed rearward of and/or adjacent or above the ankle portion 23 of the upper 20. As shown in FIG. 5, the boundary edge 22B can include a termination edge 22T and an outer edge surface 220. The outer edge surface 220 can be mirrored by an inner edge surface 221 that faces toward the interior or the void 20V of the footwear. The boundary edge can transition to a panel or panels of the upper 20 that are adjacent the boundary edge. The boundary edge 22B can be secured to the vent panel in a particular manner as described further below.

Returning to FIGS. 1 and 2, the upper can include an ankle portion 23 that can be situated adjacent or above the instep 22. This portion can provide stability and support around the wearer's ankle. The ankle portion can securely fit about the user's ankle without causing discomfort or restricting movement. This section of the boot may be reinforced to improve lateral stability while allowing for natural foot flexion. The material composition may include flexible yet durable synthetic or leather elements to provide a balance of comfort and support.

The ankle portion 23 can transition to the shaft 24. As shown in FIGS. 1 and 2, the shaft 24 can extend upward from the ankle portion. The shaft 24 can form the uppermost section of the boot, providing coverage for the lower leg and enclosing the opening through which the foot enters the void. The shaft is configured to provide adequate height for protection against environmental elements such as water, mud, or debris. The interior of the shaft may feature a smooth lining to enhance comfort and ease of entry.

Optionally, the shaft 24 can include finger straps 24A, 24B at the top thereof, positioned on the lateral and medial sides of the boot opening. These straps can provide a gripping area for the wearer to pull the boot on with ease. The straps can be secured to the shaft, either through direct molding, stitching, or reinforcement techniques that prevent detachment under force. The straps may be constructed from a durable, flexible material such as rubber, polymer, or leather to provide longevity and resilience against wear and tear.

Further optionally, the shaft 24 can include decorative stitching 24S which can border shaft regions 240 that optionally can include vents or small openings of perforations that extend through the material from which the shaft 24 is constructed. In some cases, the shaft regions 240 can be covered by or can include a mesh panel 24M or a screen, perforations or a venting material that can allow air flow through the openings, providing venting to the void 20V defined by the upper.

As mentioned above, the footwear construction 10 can include a vent panel 40. The vent panel 40 can be disposed over the aperture 22A defined in the instep 22. The vent panel 40 can extend from a position rearward of the toe box 21 over the instep 22 and adjacent or over a portion or all of the ankle 23 of the upper. The vent panel effectively can cover and conceal a part or all the aperture 22A defined in the instep 22 of the upper 20. The vent panel 40 can include a central portion 40C aligned with the longitudinal axis LA as shown in FIGS. 1, 2 and 6. The central portion 40C can extend from the toe box 21 to the ankle 23 and/or the shaft 24, above the ankle portion 23. The central portion can curve upward along a vertical plane that extends through the longitudinal axis. The central portion 40C can curve downward toward the side or quarter panels 25 of the footwear upper 20.

Optionally, the vent panel 40 can be in the form of a hyperbolic paraboloid. The vent panel thus can curve about two different axes, generally conforming to the upper curved contour of the upper between the toe box and the shaft, as well as the curved contour over the top of the foot downward toward the side panels 25 of the upper. The vent panel can extend rearward from the toe box 21 and beyond a metatarsal phalangeal joint region 28 of the footwear. The uppermost edge 44R of the vent panel can extend rearward of the metatarsal phalangeal joint and over a top of the wearer's foot to a user's ankle in the ankle portion 23 as well. The vent panel 40 can extend upward and along or adjacent the ankle region 23 of the footwear toward the shaft 24. The vent panel can include vent panel edge 40E having multiple different curved and/or angled portions extending adjacent the boundary edge 22B of the aperture 22A.

Optionally, the vent panel 40 can be constructed from a variety of materials such as polymers including thermoplastic polyurethane (TPU), ethylene vinyl acetate (EVA), polyvinyl chloride (PVC) or natural rubber, vulcanized rubber, silicone, composites and other materials with similar properties. The upper 20 and its components and regions as described herein can be constructed from another different material, such as natural leather, synthetic leather, knit textiles, nylon, moldable materials and other materials with similar properties.

Figure 3:
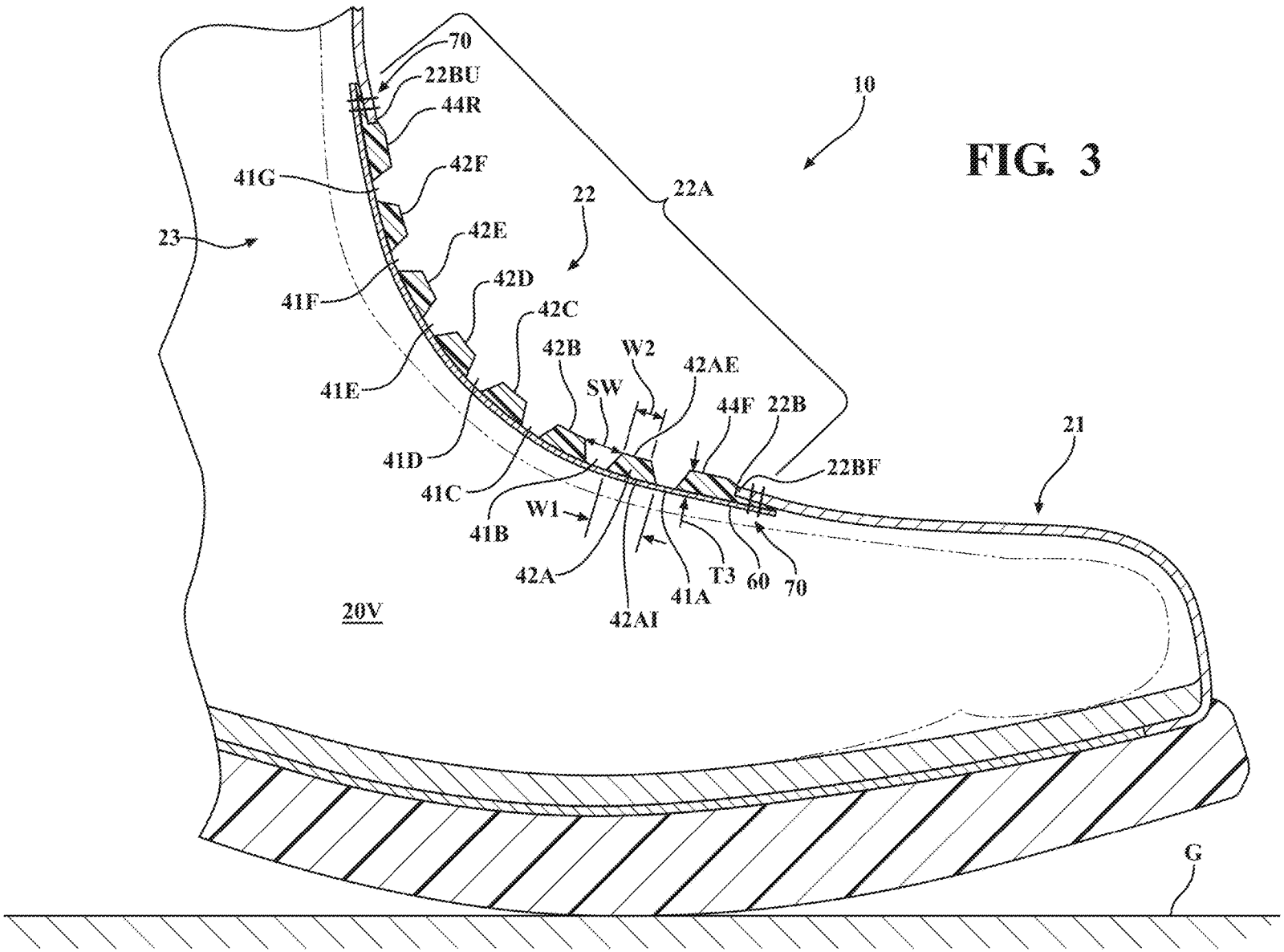
FIG. 3 is a section view of an upper, the vent panel and a mesh panel of the footwear construction in an at rest condition.
Figure 4:
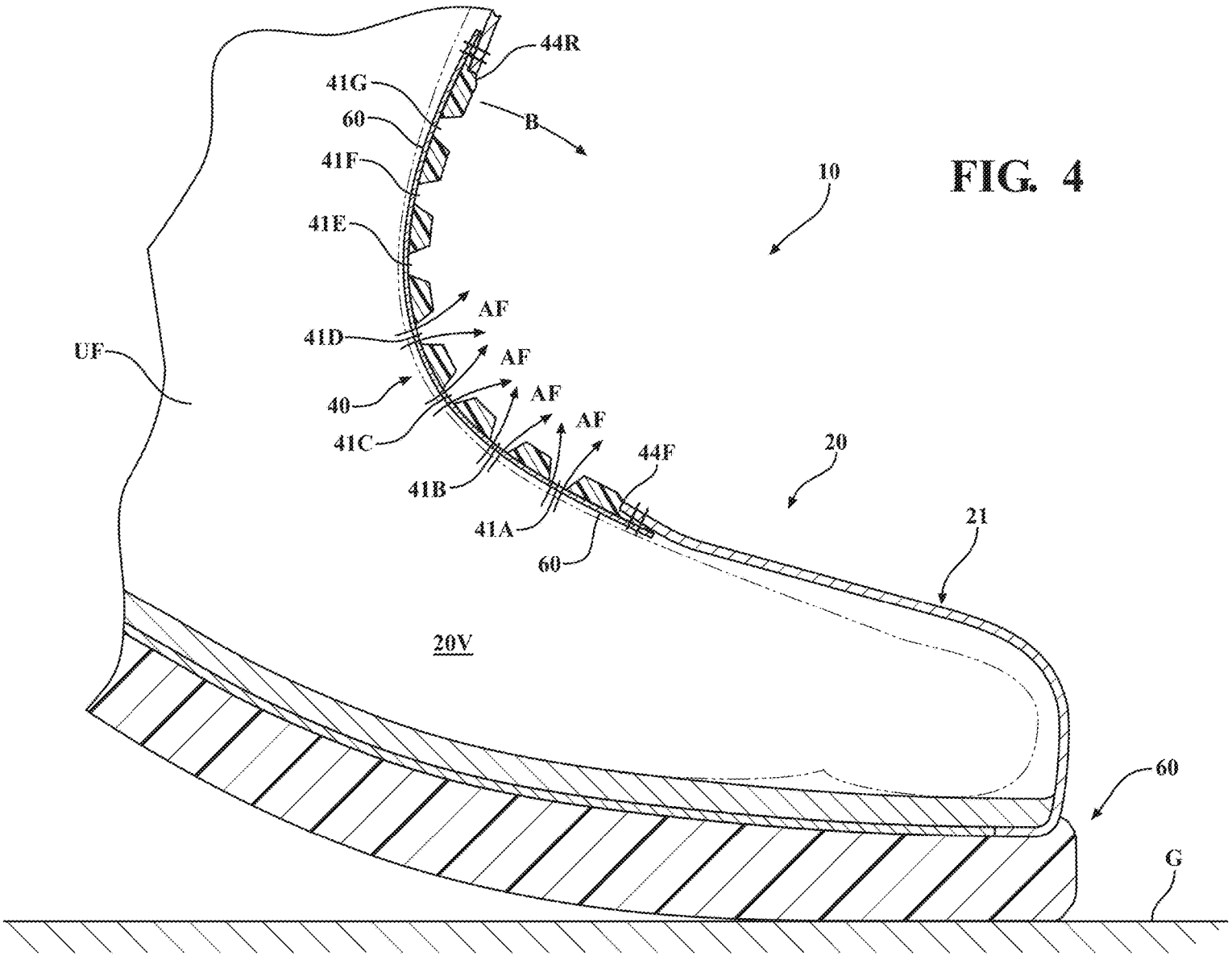
FIG. 4 is a section view of the upper, the vent panel and the mesh panel of the footwear construction at or approaching toe off during a gait cycle.

With reference to FIGS. 3-5, the vent panel, as mentioned above, can include the vent panel edge 40E. This vent panel edge 40E can include a construction to secure the vent panel edge 40E to the boundary edge 22B around the aperture 22A. Optionally, the vent panel edge 40E can include a boundary step 44. The boundary step 44 can include a flange 45 which can be in the form of a stitching flange having a second thickness T2 as compared to a first thickness T1 of the upper and/or boundary edge 22B of the upper 20. The stitching flange 45 can transition to a wall 45W that extends upward and away from the stitching flange 45 and transitions to the outer step surface 450 of the boundary step 44. The stitching flange outer surface 45S can be parallel to the outer step surface 450, with both generally transverse or perpendicular to the wall 45W.

The boundary step 44 can facilitate attachment of the boundary edge 22B to the vent panel 40 and vice versa. For example, as shown in FIG. 5, the boundary edge 22B can be placed along the boundary step 44 with the boundary edge inner surface 221 facing toward the stitching flange upper surface 45S. The terminating edge 22T of the boundary edge 22B can be disposed adjacent and/or can abut the wall 45W. The outer edge surface 220 can be aligned with or generally placed adjacent the outer step surface 450. In some cases, the outer step surface 450 and outer edge surface 220 can be flush, level or aligned with one another to provide a smooth transition between the vent panel 40 and the boundary edge 22B of the upper 20.

As also shown in FIG. 5, the vent panel 40 can be secured to the upper 20 via a stitch 70. This stitch can comprise one or more rows 71 and 72 of stitching. The stitch of course in other applications, can include only a single row or multiple additional rows. The stitch 70 can extend through the first thickness T1 and the second thickness T2 of the boundary edge in the stitching flange. The stitch can be disposed near or adjacent to the wall 45W. The stitch 70 can extend around and/or near the instep 22 of the upper 20. The stitch 22 can follow the outer boundary step 44 or vent edge 40E of the vent panel 40, optionally completely surrounding the vent panel so that all of the respective vent panel edge is secured to the boundary edge around the aperture.

Optionally, the stitching 70 can extend through an outer edge 60E of a mesh panel 60 which can be included in the construction adjacent the vent panel 40. The mesh panel can be disposed adjacent the vent panel 40 and can extend over one or more of the openings designed in the vent panel. Of course, in other applications, the mesh panel 60 can be fused to, embedded in welded to, glued to, bonded to or joined with the interior surface 401 of the vent panel 40. In most applications, the mesh panel 60 can extend over and can close off the bottom of each of the respective openings or some other part of those openings so that air can flow through the openings and the mesh panel. The mesh panel 60 also optionally can prevent excessive dirt, debris or other materials from easily falling through or entering the void 20V through the openings defined by the vent panel 40. Further optionally, the mesh edge 60E and stitching flange 45 can extend under or above the boundary edge 22B and their boundary or perimeter can be larger than the size of the aperture 22A defined by the upper in the instep.

The optional mesh panel 60 can be selected based on factors such as breathability, durability, moisture resistance, flexibility and aesthetic appeal. The mesh panel can be constructed from a conventional mesh fabric but also can be constructed from other materials. Even though constructed from such other materials, the panel can still be referred to as a mesh panel herein. Other materials suitable for the mesh panel can include perforated synthetic films like polyurethane or thermoplastic polyurethane sheets. A perforation pattern can be selected to provide ventilation while still control or provide a barrier against moisture and debris. Another material suitable for the mesh panel can include a microfiber fabric that can provide breathability and moisture resistance. The material can be treated with hydrophobic coatings to repel water while still allow air flow. Another material could be an ePTFE membrane such as GORE-TEX® which can provide waterproof yet breathable performance. Another material can be knit, woven, nylon, polyester or aramid based textiles that can provide a breathable covering for the openings in the vent panel. Yet another material can be a laser cut or stamped synthetic or genuine leather, which can be perforated to provide controlled ventilation. Other materials can include non-woven synthetic fiber mats being lightweight and offering moisture wicking capabilities.

When a mesh panel 60 is included in the construction, it can be disposed on the interior of the vent panel 40. Of course, in other constructions it might be exposed on the outside of the vent panel or portions of the mesh panel can be disposed in each of the respective openings in the mesh panel 40 as described below. Further, it will be appreciated that the mesh panel need not be a thin sheet or strip of material, rather, it can be in the form of perforated or open cell blocks or materials that can be placed in the respective openings defined by the vent panel so that air flow can pass through the same. When it is, however, in the form of a flat strip or sheet, the mesh panel can conform to the optional hyperbolic paraboloid shape of the vent panel or whatever other shape in which the vent panel is configured.

With reference to FIGS. 1-4, the vent panel 40 can define one or more openings 41A-41G. These openings can extend completely through the thickness T3 of the vent panel 40 optionally at its thickest regions. The thickness T3 of the vent panel can optionally be at least 3 mm, at least 4 mm, at least 5 mm, at least 6 mm, at least 7 mm, at least 8 mm, at least 9 mm, at least 10 mm, 3 mm to 10 mm, inclusive, 3 mm to 8 mm, inclusive, 3 mm to 5 mm, inclusive or other thicknesses depending on the performance attributes of the vent panel. This thickness can extend through any of the components of the vent panel including the transverse beams, lateral support and medial support as described below.

The openings 41A-41G optionally can include geometric shapes. As shown, they are in the form of elongated slots that extend transverse to the longitudinal axis LA. Each of the respective slots can extend from the lateral side L to the medial side M crossing the longitudinal axis LA. Of course, in other applications, the elongated slots can be truncated and can form separate slots on opposite sides of the longitudinal axis LA. The elongated slots can have a width SW that can be less than the length SL of the respective slot. The slots can be configured so that the slots increase in slot length SL as the slots become farther away from the toe box 21. Optionally, the slots can become the longest in the region where the vent panel 40 begins to transition up the ankle portion 23. For example, the slot 41E can be the longest slot and can include the longest slot length. The slots 41F and 41G, however, above that longest slot 41E, can be shorter in slot length. This can allow the vent panel to transition easily to the ankle portion 23 and extend upwardly along the front surface of the shaft 24 rather than extending around the ankle portion 23. Of course, in other applications, the vent panel can be constructed to extend around that ankle portion 23.

When the openings 41A-41G are in the form of elongated slots, each of the respective elongated slots can terminate at respective ends. Each of their respective ends can take on a variety of different geometric forms, however, as illustrated in FIG. 6, the medial end 41E1 and the lateral end 41E2 can be in the form of a round medial end and the round lateral end respectively. With these rounded ends, the ends of the slot can be less likely to crack, split, tear or otherwise become damaged or malformed. The rounded ends can provide structural integrity to the openings and the material surrounding the openings.

The respective ends of the slots 41A-41G can be disposed in and/or overlap with a respective lateral support 42L and a medial support 42M. The lateral support 42L can extend along the lateral side L of the longitudinal axis from a forward beam 44F toward a rearward beam or rearmost edge 44R. The lateral support 42L and medial support 42M can be generally symmetric about the longitudinal axis LA, however in some applications they may differ slightly for left shoes and right shoes. The lateral support 42L and medial support 42M also can include and/or form a portion of the boundary step 44 that extends around the vent panel 40. Moreover, the supports 42L and 42M can abut against the boundary edge 22B of the aperture 22A. In some cases, the supports 42L and 42M can splay or taper outward away from the longitudinal axis LA as they extend rearward from the forward beam 44F. However, adjacent or near the longer slots 41D and/or 41E, the respective supports 42L and 42M can transition, extend, angle or curve back inward toward the longitudinal axis LA as those supports extend toward the rearward most beam 44R. Of course, the slots 41F and 41G can likewise become shorter than the other slots forward of those slots due to this inward tapering of the lateral supports 42L and 42M.

Optionally, the lateral support 42L can form a lateral wing 42LW and the medial support 42M can form a medial wing 42MW. The central portion 40C of the panel 40 can extend inward from these respective wings across the longitudinal axis LA. The central portion 40C of the vent panel can extend to the rearward most beam or edge 44R which can generally form the uppermost edge of the vent panel. In this configuration, the uppermost edge of the vent panel 44R can extend farther rearward from the toe box relative to the longitudinal axis of the upper than the lateral flange 42LW and the medial flange 42MW extending from the central portion 40C of the vent panel.

With further reference to FIGS. 1, 3 and 6, the multiple holes, openings or slots 41A-41G can be separated from one another by multiple transverse beams 42A-42F. These transverse beams can be joined at their ends with the respective lateral support 42L and medial support 42M. The beams can include respective medial ends and lateral ends. The medial ends can be joined with the medial support extending on the medial side. The lateral ends can be joined with the lateral support extending on the lateral side. The boundary step 44 as mentioned above can extend along the respective medial support 42M and lateral support 42L. The beams can form the boundaries of the respective slots. The beams optionally can extend across the longitudinal axis LA, both on the medial side M and the lateral side L thereof. The beams can be parallel to one another and parallel to the slots. The beams can be transverse and/or perpendicular to the longitudinal axis LA.

As illustrated in FIGS. 1-3 and 6, the transverse beams can be disposed between respective ones of these slots defined by the vent panel. With further reference to FIG. 3, one or more of the transverse beams 42A-42F can be of a trapezoidal cross section. Of course, other cross sections, such as polygonal, round, ellipsoid, hemispherical, angled, and the like can be selected for the cross sections of the beams. Each of the beams can include an exterior face and an interior face. For example, the beam 42A can include an exterior face 42AE and an interior face 42AI as shown in FIG. 3. The interior face can include a first width W1. The exterior face 42AE can include a second width W2. The first width W1 can be greater than the second width W2. The transverse beam thus can taper from a larger width to a smaller width as the transverse beam extends away from the void 20V. Of course, in some cases the widths W1 and W2 can be equal depending on the geometric cross section.

Optionally, the slot width SW can be less than the width W1 at the bottom of the slot, closest to the mesh panel 60.

With the vent panel 40 installed relative to the upper 20, for example, in the instep 22, air flow can pass through the openings defined in the vent panel as well as any optionally included mesh panel associated with the vent panel. The air flow can flow into the void 20V as well as out of the void 20V to provide venting to a user's foot disposed in the footwear. The air flow can occur due to simple heat transfer. For example, when the air or heat within the void 20V becomes hot, it can become excited and can flow through the mesh panel 60 and out the respective openings 41A-41G, generally between the respective transverse beams bounding those openings. Air flow optionally also can flow in through those openings 41A-41G, through the mesh panel 60 and into the void 20V from the environment. This can occur during a natural gait cycle.

In some applications, the natural gait cycle of the footwear can be such that the vent panel can operate in an active venting mode. For example, as shown in FIG. 4, during toe off, a user can push off from a ground surface G thereby bending the vent panel 40, for example, moving the rearward beam 44R in direction B, somewhat toward the forward beam 44F or generally toward the toe box 21. As this occurs, the void 20V can compress and can decrease in volume. Accordingly, any air surrounding the user's foot UF will be evacuated in the form of air flow AF that exits through the openings 41A-41G. In this manner, the vent panel 40 can operate to evacuate air compressed within the void 20V around the user's foot along with any humidity or air bound perspiration. After the user has completed toe off and their foot is mid stride, along with the footwear, the void 20V can resume its former shape, for example, as shown in FIG. 3. In some cases, this can draw air flow from the environment into the air void through the respective openings, thereby providing a fresh influx of air thus venting into the void 20V. As a result, the vent panel can vent air into the footwear, thereby potentially cooling the user's foot.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and/ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Additionally, the features, structures, or characteristics of one embodiment are contemplated for proper and full combination in any suitable manner in one or more other embodiments, which is fully contemplated herein. Further, features, structures, or characteristics of one embodiment or multiple embodiments are readily and completely mixed and matched with any features, structures, or characteristics of any other embodiment or multiple embodiments in varying combinations and permutations.

What is claimed is:

1. A footwear construction comprising: an upper forming a void configured to receive a foot of a user, the upper including a longitudinal axis extending along a length of the upper and separating the upper into a lateral side and a medial side, the upper including a toe box and an instep extending rearward of the toe box, the instep defining an aperture bounded by a boundary edge that extends around the aperture along the medial side and the lateral side; a vent panel disposed over the aperture and joined with the boundary edge, the vent panel including a central portion aligned with the longitudinal axis, the vent panel being joined with the boundary edge around the aperture, the vent panel being disposed rearward of the toe box, the vent panel defining a plurality of slots that extend transverse to the longitudinal axis from the medial side to the lateral side, the plurality of slots extending completely through the central portion to allow airflow therethrough; a mesh panel extending across the vent panel and the plurality of slots from the medial side to the lateral side; and an outsole joined with the upper and including a plurality of ground contacting treads, wherein an airflow can pass through the plurality of slots and the mesh panel, and into the void and vice versa to provide venting to a user's foot disposed in the footwear; wherein the instep transitions to a shaft that is without a tongue and a lace, the shaft extending above an ankle region.

2. The footwear construction of claim 1, wherein the vent panel is in the form of a hyperbolic paraboloid, wherein the vent panel includes a vent panel edge having a plurality of different curved portions extending adjacent the boundary edge, wherein the vent panel extends rearward and beyond a metatarsal phalangeal joint region and along an ankle region of the footwear construction.

3. The footwear construction of claim 2, wherein the shaft includes a plurality of stitching elements, wherein the outsole includes an elevated heel in a heel region of the footwear construction, the elevated heel including a first part of the plurality of ground contacting treads, wherein the outsole includes a forward portion in a forefoot region of the footwear construction, the forward portion including a second part of the plurality of ground contacting treads, wherein the elevated heel and the forward portion are separated from one another by a gap in an arch region where none of the ground contacting treads are located.

4. The footwear construction of claim 1, wherein the vent panel includes a plurality of transverse beams disposed between respective ones of the plurality of slots defined by the vent panel, wherein each of the transverse beams extends across and transverse to the longitudinal axis.

5. The footwear construction of claim 4, wherein each of the plurality of transverse beams includes a trapezoidal cross section, wherein each of the beams includes an exterior face and an interior face, wherein the interior face includes a first width and the exterior face includes a second width, wherein the first width is greater than the second width.

6. The footwear construction of claim 4, wherein the vent panel includes a lateral support on the lateral side, wherein the vent panel includes a medial support on the medial side, wherein each of the plurality of transverse beams span from the lateral support to the medial support, wherein the plurality of slots are defined between the lateral support and the medial support.

7. The footwear construction of claim 6, wherein the vent panel includes a thickness of at least 3 mm in the plurality of transverse beams, the lateral support and the medial support, wherein the vent panel is of a hyperbolic paraboloid shape and disposed rearward of the toe box, wherein the vent panel is constructed from a polymer material and the upper is constructed from a leather material, wherein the vent panel is joined with the boundary edge around the aperture with a stitching thread extending through the vent panel and the upper.

8. The footwear construction of claim 7, wherein the stitching thread extends through the mesh to join the mesh with the vent panel around the aperture, wherein the mesh is conformed to the hyperbolic paraboloid shape of the vent panel.

9. The footwear construction of claim 1, wherein the shaft includes a plurality of stitching elements, wherein the shaft includes a first finger strap on the lateral side and a second finger strap on the medial side along an upper portion of the shaft.

10. The footwear construction of claim 1, wherein each of the plurality of slots are parallel to one another and perpendicular to the longitudinal axis, wherein the vent panel includes a boundary step, wherein the boundary edge is nested in the boundary step, wherein a stitch extends through the boundary step, the boundary edge, and a mesh edge of the mesh panel around the aperture.

11. A footwear construction comprising: an upper forming a void configured to receive a foot of a user, the upper including a forefoot region, an arch region and a heel region, the upper including a longitudinal axis extending along a length of the upper and separating the upper into a lateral side and a medial side, the upper including a toe box in the forefoot region and an instep extending rearward of the toe box within at least one of the forefoot region and the arch region, the instep defining an aperture bounded by a boundary edge that extends around the aperture along the medial side and the lateral side, the boundary edge having a first thickness; a vent panel disposed over the aperture and joined with the boundary edge, the vent panel including a central portion aligned with the longitudinal axis, the vent panel including a boundary step including a stitching flange and a wall extending away from the stitching flange, the stitching flange including a second thickness, the boundary step being stitched to the boundary edge around the aperture with a stitch extending through the first thickness and the second thickness with the 4 boundary edge being disposed adjacent the wall, the vent panel being of a hyperbolic paraboloid shape and disposed rearward of the toe box, the vent panel defining a plurality of elongated slots that extend transverse to the longitudinal axis from the medial side to the lateral side, the plurality of elongated slots extending completely through a third thickness of the central portion; a mesh panel extending across the plurality of elongated slots from the medial side to the lateral side; and an outsole joined with the upper and including a plurality of ground contacting treads, wherein an airflow can pass through the plurality of elongated slots and the mesh panel, and into the void and vice versa to provide venting to a user's foot disposed in the footwear; wherein the instep transitions to a shaft that is without a tongue and a lace, the shaft extending above an ankle region.

12. The footwear construction of claim 11, wherein the boundary step includes an outer step surface, wherein the boundary edge includes an outer edge surface, wherein the outer step surface and outer edge surface are flush with one another.

13. The footwear construction of claim 12,
wherein the vent panel is constructed from a polymer material,
wherein the upper is constructed from a leather material,
wherein the vent panel includes a plurality of beams between the respective plurality of elongated slots,
wherein each of the plurality of beams includes the third thickness,
wherein each of the plurality of beams includes a medial end and a lateral end,
wherein the medial end is joined with a medial support extending on the medial side,
wherein the lateral end is joined with a lateral support extending on the lateral side,
wherein the boundary step extends along the medial support and along the lateral support,
wherein the mesh panel is joined with the vent panel along the lateral support and along the medial support.

14. The footwear construction of claim 11,
wherein the vent panel includes a plurality of beams between the respective plurality of elongated slots,
wherein each of the plurality of beams is separated from one another by a first distance,
wherein each of the plurality of beams tapers in cross section from an interior surface of each beam to an exterior surface of each beam, such that each beam is wider near the void.

15. The footwear construction of claim 11,
wherein the vent panel includes a lateral support on the lateral side,
wherein the vent panel includes a medial support on the medial side,
wherein the mesh panel is stitched with the stitch to the medial support,
wherein the mesh panel is stitched with the stitch to the lateral support.

16. The footwear construction of claim 11, wherein the shaft includes a plurality of stitching elements, wherein the shaft includes a first finger strap on the lateral side and a second finger strap on the medial side along an upper portion of the shaft.

17. A footwear construction comprising: an upper forming a void configured to receive a foot of a user, the upper including a longitudinal axis extending along a length of the upper and separating the upper into a lateral side and a medial side, the upper including a toe box and an instep extending rearward of the toe box, the instep defining an aperture bounded by a boundary edge that extends around the aperture along the medial side and the lateral side, the upper including a shaft extending above the instep, the shaft including a finger strap along the shaft; a vent panel disposed over the aperture and joined with the boundary edge around the aperture, the vent panel being disposed rearward of the toe box, the vent panel defining a plurality of holes that extend transverse to the longitudinal axis from the medial side to the lateral side, the plurality of holes being separated from one another via plurality of transverse beams adjacent respective ones of the plurality of holes, the vent panel including a vent panel interior surface; a mesh panel disposed adjacent the vent panel interior surface; and an outsole joined with the upper, wherein an airflow can pass through the plurality of holes and the mesh panel, and into the void and vice versa to provide venting to a user's foot disposed in the footwear.

18. The footwear construction of claim 17,
wherein the aperture and vent panel over the aperture are contained within the instep only,
wherein the vent panel is distal from the outsole and toe box,
wherein each of the plurality of holes is a slot extending perpendicular to the longitudinal axis,
wherein each slot includes a rounded medial end and a rounded lateral end.

19. The footwear construction of claim 18,
wherein the vent panel includes a boundary step including a stitching flange and a wall extending away from the stitching flange,
wherein the boundary step is stitched to the boundary edge around the aperture with a stitch, the boundary edge being disposed adjacent the wall,
wherein the boundary step includes an outer step surface,
wherein the boundary edge includes an outer edge surface,
wherein the outer step surface and outer edge surface are flush with one another.

20. The footwear construction of claim 19,
wherein each of the plurality of transverse beams tapers in cross section from an interior surface of each beam to an exterior surface of each beam, such that each beam is wider near the void.

* * * * *